US012006176B2

(12) United States Patent
Haapanen

(10) Patent No.: US 12,006,176 B2
(45) Date of Patent: Jun. 11, 2024

(54) METHOD OF CONTROLLING CALIPER OF THE FIBER WEB OF A PARENT ROLL AND PRODUCTION LINE FOR PRODUCING FIBER WEBS

(71) Applicant: Valmet Technologies, Inc., Espoo (FI)

(72) Inventor: Jaakko Haapanen, Järvenpää (FI)

(73) Assignee: Valmet Technologies, Inc., Espoo (FI)

( * ) Notice: Subject to any disclaimer, the term of this patent is extended or adjusted under 35 U.S.C. 154(b) by 627 days.

(21) Appl. No.: 17/153,105

(22) Filed: Jan. 20, 2021

(65) Prior Publication Data

US 2021/0155436 A1 May 27, 2021

(30) Foreign Application Priority Data

Nov. 22, 2019 (FI) ..... 20196003

(51) Int. Cl.
*D21F 7/06* (2006.01)
*B65H 26/08* (2006.01)
*D21F 9/00* (2006.01)

(52) U.S. Cl.
CPC ..... *B65H 26/08* (2013.01); *D21F 7/06* (2013.01); *D21F 9/00* (2013.01); *B65H 2515/12* (2013.01)

(58) Field of Classification Search
CPC .... D21F 7/06; D21F 9/00; B65H 6/08; B65H 2515/12
USPC ..... 162/100
See application file for complete search history.

(56) References Cited

U.S. PATENT DOCUMENTS

| | | | |
|---|---|---|---|
| 3,009,666 | A | 11/1961 | Moser |
| 4,535,950 | A | 8/1985 | Isnyansky |
| 2003/0011629 | A1 | 6/2003 | Lin et al. |
| 2003/0116296 | A1 | 6/2003 | Lin et al. |
| 2004/0154391 | A1 | 8/2004 | Paanasalo |
| 2008/0017748 | A1 | 1/2008 | Seger et al. |
| 2012/0253496 | A1 | 10/2012 | Malczewski |

FOREIGN PATENT DOCUMENTS

| | | | |
|---|---|---|---|
| CN | 101616857 | A | 12/2009 |
| CN | 103108821 | A | 5/2013 |
| CN | 108883886 | A | 11/2018 |
| CN | 109963982 | A | 7/2019 |
| DE | 2932396 | A1 | 2/1981 |
| DE | 4128706 | A1 | 3/1993 |
| EP | 2107997 | B1 | 9/2013 |
| JP | 59143837 | A | 8/1984 |
| WO | 02102693 | A1 | 12/2002 |
| WO | 2004094282 | A1 | 11/2004 |

OTHER PUBLICATIONS

Extended European Search Report for EP20203987 dated Apr. 20, 2021.
Office Action issued by the Finnish Patent and Registration Office for FI20206035 dated Apr. 1, 2021.
Finnish Patent and Registration Office Search Report, for FI 20196003, dated Mar. 9, 2020.

*Primary Examiner* — Mark Halpern
(74) *Attorney, Agent, or Firm* — Stiennnon & Stiennon

(57) ABSTRACT

To minimize the cost of a fiber web due to the web, particularly a board web, being manufactured overly thick to compensate for loss of caliper in the reel-up, the web is made thicker just for the inner layers of what will become a parent roll. The caliper of the web is measured as or after it is unwound. A caliper curve of the parent roll as a function of the diameter of the parent roll is calculated as a function of the diameter of the parent roll and/or the customer roll. The fiber web is adjusted by changing running parameters of the production line: web speed i.e. production speed, headbox-flow, head-box consistency, coating weight of the coating paste or calender nip load.

19 Claims, 4 Drawing Sheets

METHOD OF CONTROLLING CALIPER OF THE FIBER WEB OF A PARENT ROLL AND PRODUCTION LINE FOR PRODUCING FIBER WEBS

CROSS REFERENCES TO RELATED APPLICATIONS

This application claims priority on Finnish Application No. 20196003, filed Nov. 22, 2019, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to production of fiber webs, in particular to producing board webs.

As known from the prior art in fiber web producing processes typically comprise an assembly formed by a number of apparatuses arranged consecutively in the process line. A typical production and treatment line comprises a head box, a wire section and a press section as well as a subsequent drying section and a reel-up. The production and treatment line can further comprise other sections and devices for finishing the fiber web, for example a sizer, a coating device and a calender. The production and treatment line also typically comprises at least one slitter-winder for forming customer rolls as well as a roll packaging apparatus. And as known, fiber webs, such as paper or board webs, are manufactured in machines together forming a fiber web manufacturing line, which may be hundreds of meters long.

In fiber web manufacturing lines, manufacturing operates as a continuous process and the process is generally run with constant speed and with constant basis weight, when producing selected fiber web grade. The finished fiber web being output from the machine is wound with a reel-up around a reeling shaft, i.e. a reel spool, into a parent roll (a machine roll), the diameter of which may be more than 5 meters, and which may weigh more than 160 tons. The purpose of the reeling is to transfer the fiber web from its planar manufacturing form into a form in which it can be handled more easily. The reel-up is thus a device that reels a material, which is produced as a continuous fiber web in a fiber web production line, into form of a roll; the parent roll. In the production process of the fiber web, the reeling is generally a first process part, wherein a continuous process is discontinued to be continued in sequences. The parent roll is formed around the reeling shaft that functions as a core of reeling, i.e. the fiber web on one parent roll around one reeling shaft has a beginning and an end.

The parent roll is wound up to be just as tight as to endure reeling, storage including roll transfers and later unwinding. Typically, the goal is for the parent roll tightness to decrease from inner layers to surface or, at least, to remain the same. It is known from prior art to define real-time parent reel or wound roll caliper and density by a measurement and calculation system. It is also known to define wound-in caliper profiles during reeling. One known system is described in WO patent application publication 02102693 A1. The reeling parameters: nip load, web tension and peripheral force, are determined based on for example: properties of paper or board, such as smoothness, stiffness, compressibility and friction coefficient, the parent roll size, handling method, storage time and running speed. The reeling parameters are typically only changed when the fiber web grade changes or if there are reeling problems.

The web of the parent roll generated during manufacture is full-width and even more than 100 km long, so it must be cut into partial webs of a suitable width and length for customers and wound around cores into "customer rolls" before dispatch from the mill. As known, this slitting and winding of the web takes place in a separate machine fitted to the purpose, i.e., a slitter-winder. In the slitter-winder the parent roll is unwound in the unwinding station off the reeling shaft and the broad web is slit with the slitting section into a number of narrower partial webs, which are wound with the winding section in the winder around winding spools such as cores into customer rolls. When the customer rolls are ready, the slitter-winder is stopped and the rolls, or "set", is removed from the machine. After this, the process continues with the winding of a new set. These stages are repeated periodically until the fiber web on the parent roll runs out from the reeling shaft, at which point the parent roll is replaced and the operation restarts with the unwinding of a new parent roll from the reeling shaft.

Fiber webs, especially paper and board are available in a wide variety of types and can be divided according to basis weight in two grades: papers with a single ply and a basis weight of 25-300 g/m$^2$ and boards manufactured in one or multi-ply technology and having a basis weight of 150-600 g/m$^2$. It should be noted that the borderline between paper and board is flexible since board grades with lightest basis weights are lighter than the heaviest paper grades. Generally speaking, paper is used for printing and board for packaging. The main carton board grades are folding boxboard (FBB), white-lined chipboard (WLC), solid bleached board (SBS) and liquid packaging board (LPB). In general, these grades are typically used for different kinds of packaging of consumer goods. Carton board grades vary from one-up to five-ply boards (150-400 g/m$^2$). The top side is usually coated with from one to three layers (20-40 g/m$^2$), the back side has less coating or no coating at all.

Bulkiness i.e. the relation of thickness of the fiber web to its grammage (basis weight), of board webs is reduced during reeling and typically bulk loss is greatest in the inner layers of the parent roll as the stresses inside the parent roll cause caliper losses. Additionally, some bulk loss may occur during winding in the slitter-winder. Due to this in board manufacturing the board web is typically produced in caliper values exceeding the target value, even 5%, in order to reach the target value in the worst case. Thus, of the production time even over 90% of time is run with caliper values that exceed the target value. This has a significant negative input economically. These disadvantages and problems also increase when the bulkiness of the fiber web increases.

In EP publication 2107997 A1 is disclosed a method for winding continuous web material to form a substantially fully compressed roll of the wound web material so that the machine direction tension in the web is substantially uniform throughout the wound roll of web material. In the method a compensated Wound On Tension (WOT) profile is generated and the compensated WOT profile varies as a function of the wound roll diameter and the compensated WOT profile is the WOT that is needed in the web as the web is being wound onto the roll in order to provide the wound roll with a substantially uniform thru-roll machine direction (MD) tension. In the method the compensated WOT profile can be converted to speed control based on a predetermined relation between winder speed and WOT for the web.

An object of the invention is to create a method of controlling caliper of the fiber web of a parent roll and a production line for producing fiber webs, in which the disadvantages and problems of the prior art are eliminated or at least minimized.

A particular object of the invention is to create a method of controlling caliper of the fiber web and the production line for producing fiber webs, in which the disadvantages and problems of the prior art relating to running the production of the fiber web with caliper values exceeding the target values are eliminated or at least minimized.

SUMMARY OF THE INVENTION

In order to minimize the cost of a fiber web due to web being manufactured with a caliper i.e., thickness, which is overly thick so as to compensate for loss of caliper in the reel-up, the web is made thicker just for the inner layers of what will become a parent roll. In addition, the web may be thickened just before a reel change, so the new reel starts with a thicker web. The caliper of the fiber web, in particular a board web, is increased in the fiber web machine before it is wound onto the parent roll in a reel-up. The increased caliper is based on the caliper of the web in the parent roll after the parent roll is formed. The caliper of the web is measured as it is being unwound. The measurement of the caliper may be by periodically taking web samples and measuring their thickness. Alternatively or additionally measurement of the caliper may be by measuring the diameter of the unwinding parent roll and based on the rotation rate of the parent roll calculating the caliper as a function of parent roll diameter. Measurement of the caliper may be made on customer rolls being formed in the reel-up by periodically taking web samples of the customer rolls and measuring their thickness. The production line for producing fiber webs according to the invention further comprises a database and calculating device to collect and store caliper data received from at least one measuring device. A caliper curve of the parent roll is a curve showing caliper calculated as a function of the diameter of the parent roll and/or the customer roll and is output data which is sent as input data to a control device of the fiber web production line to adjust at least one of the following running parameters of the production line: web speed i.e. production speed, headbox-flow, head-box consistency, coating weight of the coating paste, or calender nip load is adjusted before reeling of the parent roll so as to control the caliper of the fiber web.

In this description and in the claims by the expression "inner layers of a parent roll" is meant 10%, advantageously 5%, of the whole length of the fiber web on the parent roll.

According to the invention a method of controlling the caliper of the fiber web of a parent roll produced in a fiber web production line comprising employing a head box, a forming section, a press section, a drying section, a calender, a coating section, a reel-up, an unwinding station of a slitter-winder, a slitting section of the slitter-winder, a winding section of the slitter-winder, wherein the caliper of the fiber web of the parent roll is controlled as a function of the diameter of the parent roll.

According to an advantageous feature of the invention in the method at least one of the following running parameters of the production line: web speed i.e. production speed, headbox-flow, head-box consistency, coating weight of the coating paste and/or calender nip load is adjusted for reeling of the parent roll to control the caliper of the fiber web.

According to an advantageous feature of the invention in the method caliper of the fiber web to be wound as inner layers of the parent roll is adjusted to exceed a set target value of the caliper of the fiber web by adjusting the running parameter or parameters.

According to an advantageous feature of the invention method, the finished parent roll is provided the fiber web with desired caliper as a function of the diameter so that the parent roll or the customer roll has constant caliper or nearly constant caliper.

According to an advantageous feature of the invention the running parameter or parameters are adjusted commencing at the lasted at the time for the fiber web to be reeled as the innermost layer of the parent roll. The parameter or parameters remain adjusted for a time-interval corresponding to reeling the inner layers of the parent roll. According to an advantageous aspect it is preferable if the running during a changing parameter is timed to correspond to the time when running bottom or surface waste layers of the parent roll.

According to an advantageous feature of the invention the running speed of the production line is decreased in order to provide fiber web with caliper values exceeding the target value of the caliper of the fiber web for the inner layers of the parent roll.

According to an advantageous feature of the invention to provide fiber web with caliper values exceeding the target value of the caliper of the fiber web for the inner layers of the parent roll is provided by increasing the headbox-flow and/or by increasing the head-box consistency and/or by increasing the coating weight of the coating paste and/or by reducing thee calender nip load.

According to an advantageous feature of the invention time interval for the run with adjusted running parameters for the run of the inner layers of the parent roll is defined advantageously by caliper data calculated based on data received from an on-line measurement device, advantageously sensors, at the unwinding station of the slitter-winder and/or from an on-line measurement devices, advantageously sensors, at winding section of the slitter-winder. The caliper data can be calculated based on calculation systems known as such, for example as described in WO patent application publication 02102693 A1.

According to an advantageous feature of the invention the fiber web is produced in a fiber web production line further comprising a parent roll storage with a sample taking station and/or a customer roll storage with a sample taking station and time interval for the run with adjusted running parameters for the run of the inner layers of the parent roll is defined advantageously by caliper measurement data received the sample taking station(s).

According to an advantageous feature of the invention the method comprises:

- a target setting step, in which target caliper data of the fiber web is set,
- a parameter selection step, in which the running parameters, web speed i.e. production speed, the headbox-flow and/or the head-box consistency, the coating weight of the coating paste to be applied onto the fiber web at the coating section and the calender nip load of the calender are selected and defined to produce a fiber web with the target caliper,
- a measurement step, in which the caliper data is received,
- a checking step, in which based on the received caliper data it is checked whether the caliper of the fiber web as a function of the diameter of the parent roll or the customer roll is as desired, advantageously constant, in the parent roll and/or in the customer roll,
- and if the caliper of the fiber web in the parent roll and/or in the customer roll is not as desired, advantageously constant, the return branch is selected, and the diameter dependent correction factor is changed in a factor changing step and the selected running parameter(s) are changed accordingly in the parameter selection step.

According to an advantageous feature of the invention the method further comprises: a sample measurement step, in which caliper data is received and thereafter a sample checking step and based on the sample measurement step, received caliper data is checked as to whether the caliper of the fiber web is a function of the diameter of the parent roll or the customer roll as desired, advantageously constant, in the parent roll and/or the customer roll and if the caliper of the fiber web in the parent roll and/or in the customer roll is not as desired, advantageously constant, an additional return branch is selected and the diameter dependent correction factor is changed in the factor changing step and the selected running parameter(s) are changed accordingly in the parameter selection step.

According to the invention the production line for producing fiber webs comprises a head box, a forming section, a press section, a drying section, a calender, a coating section, a reel-up, an unwinding station of a slitter-winder, a slitting section of the slitter-winder, a winding section of the slitter-winder and measuring devices, for example sensors, advantageously on-line measuring devices, to measure the diameter of the parent roll to calculate the caliper of the fiber web, for example based on calculation systems known as such, for example as described in WO patent application publication 02102693 A1, to be unwound in the unwinding station and/or to define the caliper of the fiber web to be wound to a customer roll in the winding section, wherein the production line further comprises a database and calculating device to collect and store the measurement data received from the measuring means and to calculate, for example as described in WO patent application publication 02102693 A1, and determine the caliper curve of the parent roll as a function of the diameter of the parent roll and to calculate the caliper as function of the diameter of the parent roll and/or the customer roll as out-put data sent as in-put data to a control device of the fiber web production line to adjust at least one of the following running parameters of the production line: web speed i.e. production speed, headbox-flow, head-box consistency, coating weight of the coating paste and/or calender nip load is adjusted for reeling of the parent roll to control the caliper of the fiber web.

According to an advantageous feature of the invention the production line further comprises a parent roll storage, a sample taking station at the parent roll storage and/or a customer roll storage and a sample taking station at the customer roll storage to take samples of the fiber web in order to define the caliper of the fiber web.

According to an advantageous aspect of the present invention the caliper of the fiber web is controlled as a function of the diameter of the parent roll in unwinding in the unwinding station of the slitter-winder, alternatively or additionally as a function of the diameter of the customer rolls of the set. Advantageously, the caliper is increased before the turn-up (change to new parent roll winding) in the reel-up and for a set time increased caliper is reeled as the inner layers of the parent roll. There after the caliper is set to the target value. Thus, in unwinding, the caliper of the unwound fiber web is with desired caliper as a function of the diameter of the parent roll, advantageously with constant caliper/the caliper of the fiber web to be unwound from a customer roll is with the desired caliper as a function of the diameter of the customer roll, advantageously with constant caliper. Advantageously, the time of running increased caliper is about 10% of the reeling of one parent roll in the reel-up.

According to an advantageous aspect of the invention based on caliper curve of the parent roll in unwinding in the unwinding station of the slitter-winder the caliper of the fiber web is adjusted by decreasing the production speed of the production line, typically 2-3%, if required even up to 10%, such that the fiber web to be reeled as inner layers of the parent roll will have increased caliper to compensate the bulk loss of the reeling and winding.

According to another advantageous aspect of the invention based on caliper curve of the customer roll set produced in the slitter-winder the caliper of the fiber web is adjusted by decreasing the production speed of the production line, typically 2-3%, if required even up to 10%, such that the fiber web to be reeled as inner layers of the parent roll will have increased caliper to compensate the bulk loss of the reeling and winding.

Alternatively, to provide the increased caliper to the inner layers of the parent roll the consistency of the head-box and/or flow at the slice of the head-box is adjusted correspondingly for the inner layers of the parent roll. In case a multi-ply fiber web is produced, for example only the consistency of the middle layer head-box and/or flow at the slice of the middle-layer head-box is adjusted.

Alternatively, to provide the increased caliper to the inner layers of the parent roll the coating weight of the coating paste to be applied onto the fiber web at the coating section is adjusted correspondingly for the inner layers of the parent roll.

Alternatively, to provide the increased caliper to the inner layers of the parent roll the calender nip load is adjusted correspondingly for the inner layers of the parent roll.

By the invention and its advantageous features many advantages are achieved: amount of raw material used, and energy consumed decreased several percent and still the target values of the fiber web produced are achieved. Thus, significant environmental and economical saving are also achieved.

BRIEF DESCRIPTION OF THE DRAWINGS

In the following the invention is explained in detail with reference to the accompanying drawing to which the invention is not to be narrowly limited.

During the course of the following description like numbers and signs will be used to identify like elements according to the different views which illustrate the invention and its advantageous examples. In the figures some repetitive reference signs have been omitted for clarity reasons.

DESCRIPTION OF THE PREFERRED EMBODIMENTS

Figure 1:
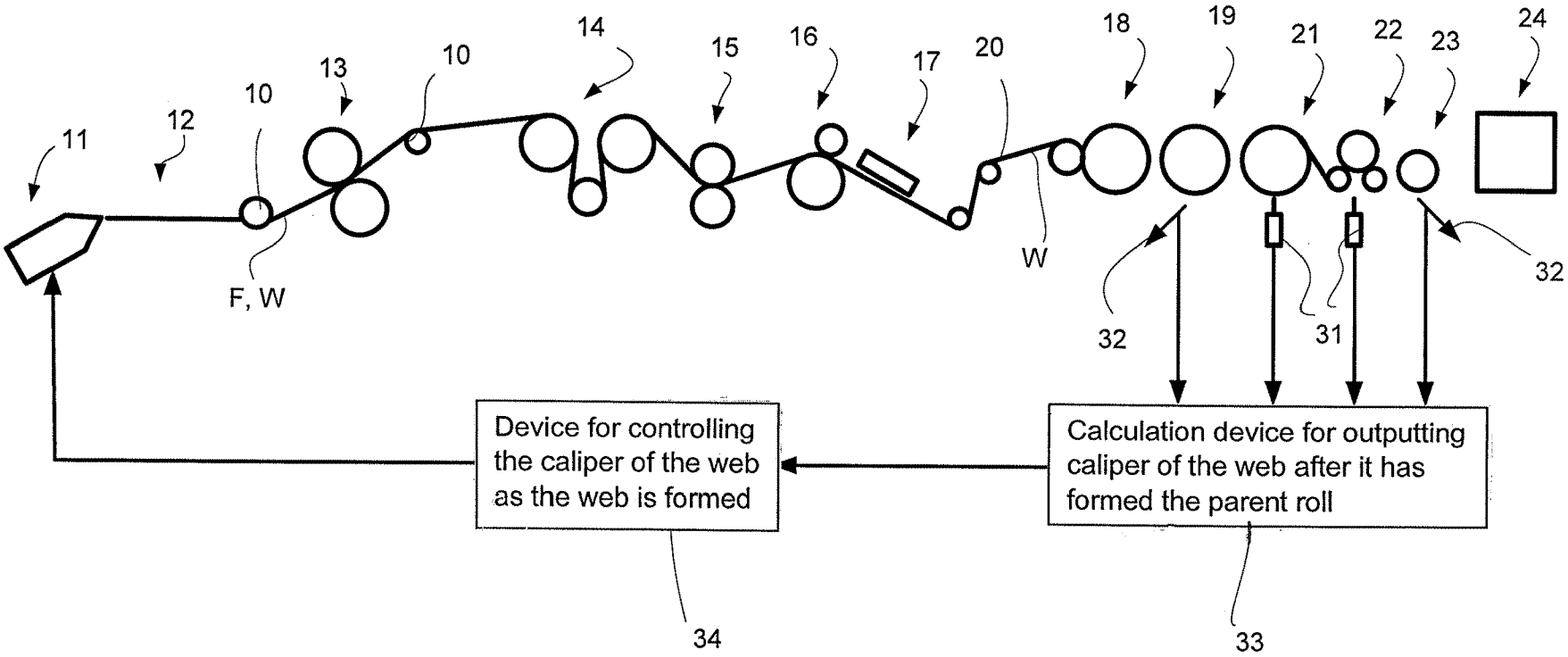
In FIG. 1 is shown schematically an advantageous example of a fiber web production line according to the invention.

In FIG. 1 is very schematically shown a fiber web production line which comprises a head box 11, a forming section 12, a press section 13, a drying section 14, a calender 15, a coating section 16 with drying equipment 17, a reel-up 18, a parent roll storage 19, an unwinding station 21 of a slitter-winder, a slitting section (not shown) of the slitter-winder, a winding section 22 of the slitter-winder and a customer roll storage 23, as well as a packaging section 24. In the production line there are also guide rolls 10, 20 for guiding and supporting the fiber web W and/or the fabric F supporting the web W. The fiber web W is typically supported by fabrics during forming, pressing, and drying. The production line comprises measuring devices 31, for example sensors, advantageously on-line measuring devices, with a calculation system to measure and calculate for example as described in WO patent application publication 02102693 A1, the caliper of the fiber web W of the parent roll to be unwound in the unwinding station 21 and/or to define the caliper of the fiber web to be wound to a customer roll in the winding section 22. The production line may also comprise sample taking stations 32 at the parent roll storage 19 and/or at the customer roll storage 23 to take samples of the fiber web in order to define the caliper of the fiber web W. The production line further comprises a database and calculating device 33 to collect and store the caliper data received from the measuring devices with the calculation system and/or from the sample taking stations received information and to calculate and determine the caliper curve of the parent roll and/or to calculate the caliper as function of the diameter of the parent roll/the customer roll as out-put data sent as in-put data to a control device 34 of the fiber web production line to control production speed of the fiber web production line in order to decrease the production speed during reeling of the inner layers of the parent roll in the reel-up 18 to increase caliper and bulkiness temporarily for the inner layers of the parent roll to provide a parent roll with desired, advantageously constant target caliper fiber web as a function of the diameter of the parent roll for unwinding in the unwinder station 21 of the slitter-winder.

Figure 2:
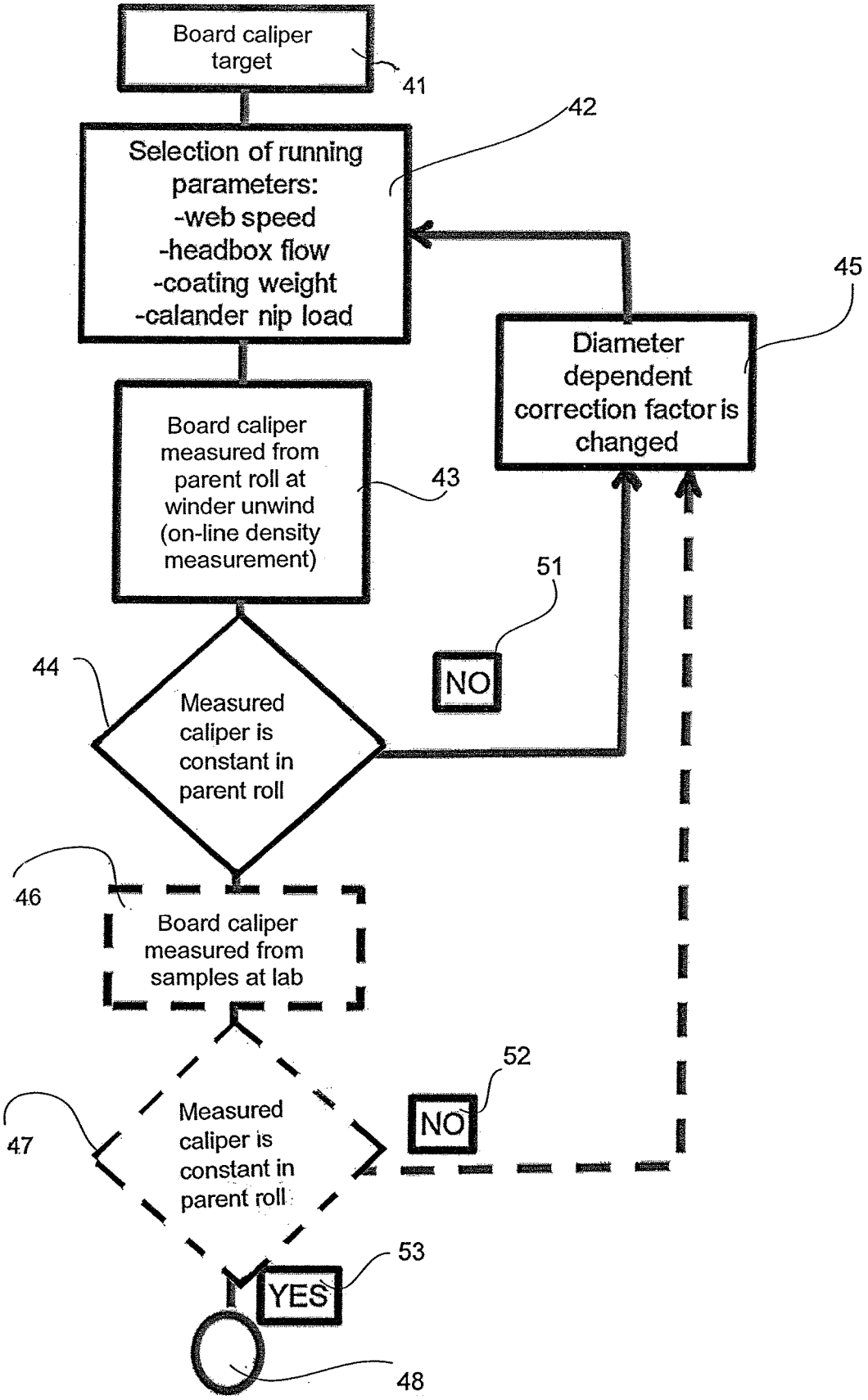
In FIG. 2 is shown a schematical example as flowchart illustrating steps of the method of controlling caliper of a fiber web of a parent roll.

In FIG. 2 is shown a schematical example as a flowchart illustrating steps of the method of controlling caliper of a fiber web of a parent roll. Each fiber web grade has grade-based correction factor. In the target setting step 41 of the method the target caliper data of the fiber web is set and thereafter in the parameter selection step 42 the running parameters, web speed i.e. production speed, headbox-flow and/or head-box consistency, coating weight of the coating paste to be applied onto the fiber web at the coating section and/or calender nip load of the calender for the fiber web production line are selected and defined to produce a fiber web with the target caliper. In the measurement step 43 caliper data (advantageously calculated based on on-line measurement results with a calculation system received form a parent roll at the unwinding section of the slitter-winder) is received and thereafter in the checking step 44 based on the received caliper data is checked whether the caliper of the fiber web is desired as a function of the diameter of the parent roll and/or the customer roll, advantageously constant in the parent roll and/or in the customer roll. If the caliper of the fiber web in the parent roll is not as desired as a function of the diameter of the parent roll and/or the customer roll, advantageously the return branch 51 i.e. "NO" is selected and the diameter dependent correction factor is changed in factor changing step 45 and the selected running parameter(s) are changed accordingly in the parameter selection step 42. Additionally (or alternatively) in sample measurement step 46 caliper data (advantageously calculated based on on-line caliper data received form the of a sample taking station) is received and thereafter in the sample checking step 47 based on the sample measurement step 46 received caliper data is checked as to whether the caliper of the fiber web is as desired as a function of the diameter of the parent roll/the customer roll, advantageously constant in the parent roll and/or in the customer roll. If the caliper of the fiber web in the parent roll is not as desired, advantageously constant, the additional return branch 52 i.e. "NO" is selected and the diameter dependent correction factor is changed in factor changing step 45 and the selected running parameter(s) are changed accordingly in the parameter selection step 42. In case the caliper is desired as a function of the diameter of the parent roll and/or the customer roll, advantageously constant in the parent roll the continuation branch 53 "YES" is selected and the production is continued with set parameters.

According to an advantageous example of the invention, here explained with reference to the examples of FIGS. 1-2, in the method the caliper of the fiber web W of the parent roll is controlled as a function of the diameter of the parent roll. In the method at least one of the following running parameters of the production line: web speed i.e. production speed, headbox-flow, head-box consistency, coating weight of the coating paste and/or calender nip load is adjusted for reeling of a parent roll such that the caliper of the fiber web W to be wound as inner layers of the parent roll exceeds the target value and the desired caliper as a function of the diameter of the parent roll and/or the customer roll, advantageously constant caliper of the fiber web of the parent roll is achieved. Thus, the parameter(s) are adjusted beginning at the time for the fiber web W to be reeled as the innermost layer of the parent roll for a time-interval corresponding to reeling the inner layers of the parent roll. Advantageously, the running speed of the production line is decreased in order to run fiber web W with "over caliper" i.e. with caliper values exceeding the target value of the caliper of the fiber web W for the inner layers of the parent roll. The "over caliper" run is also achieved by increasing the headbox-flow, by increasing the head-box consistency, by increasing the coating weight of the coating paste and/or by reducing the calender nip load. The time interval needed by the "over caliper" run of the inner layers of the parent roll is defined advantageously by measurement data received from an on-line measurement device 31, advantageously sensors, with the calculation system at the unwinding station 21 of the slitter-winder. Additionally or alternatively, the time interval needed by the "over caliper" run of the inner layers of the parent roll is defined by measurement data received from an on-line measurement device 31. Advantageously the sensors are used with a calculation system at winding section 22 of the slitter-winder and/or caliper measurement data received from a sample taking station 32 at the parent roll storage 19 and/or at the customer roll storage 23.

Figure 3A:
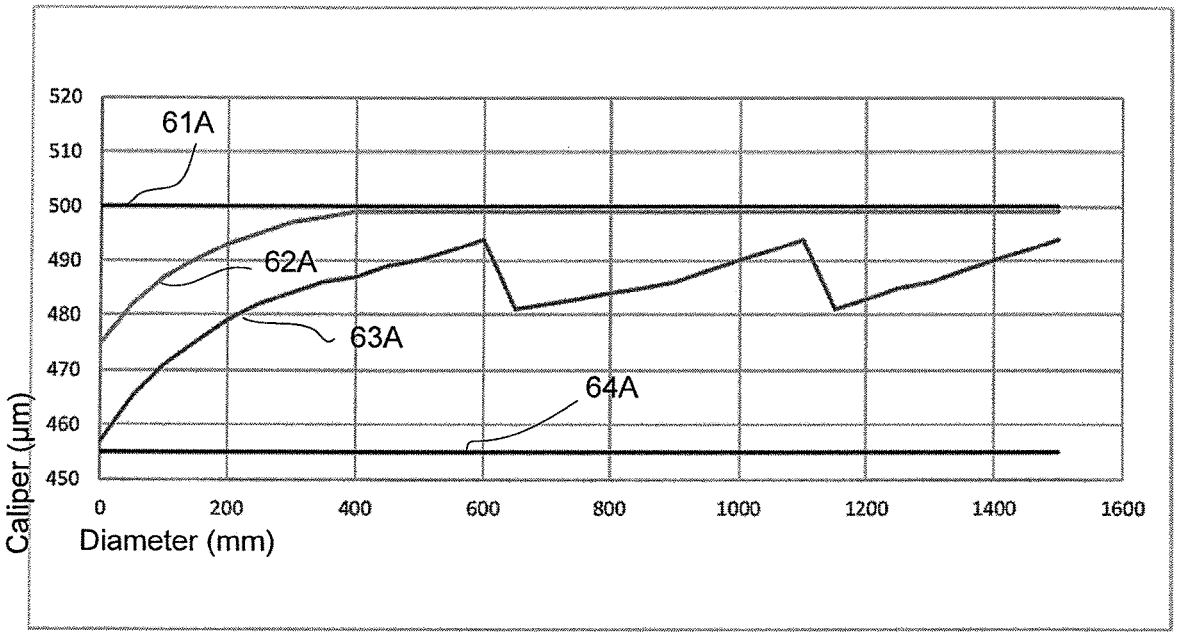
Fig. 3A prior art
In FIGS. 3A-3B is schematically shown example graphs of caliper losses, in FIG. 3A in accordance prior art and in FIG. 3B in accordance with the invention.
Figure 3B:
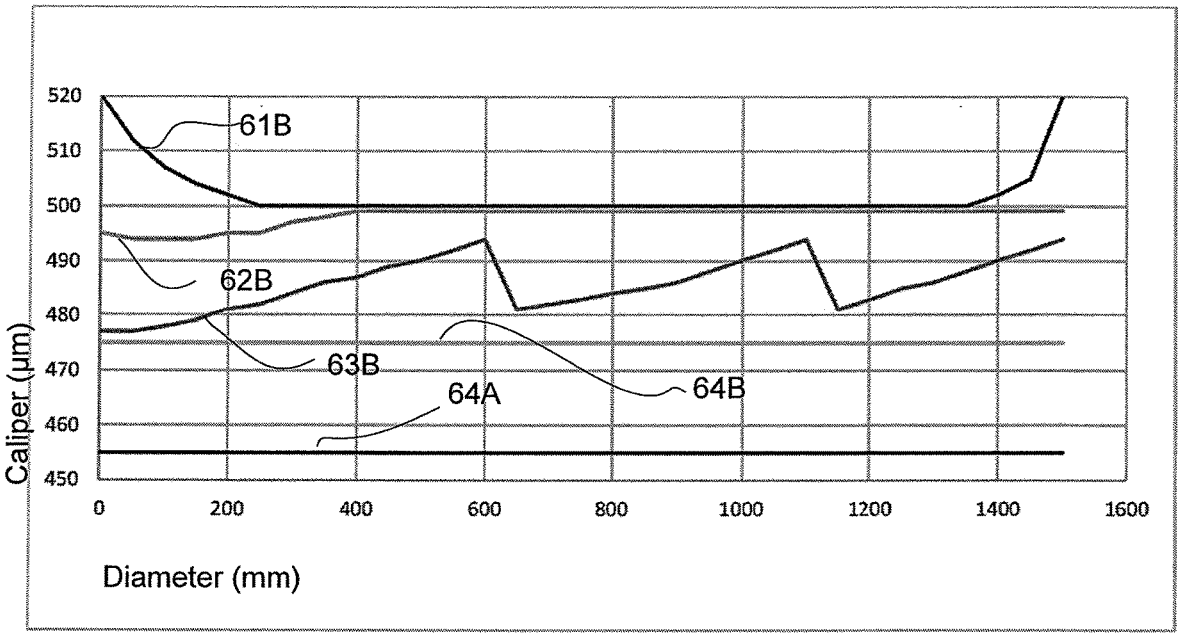

In FIGS. 3A-3B is schematically shown example graphs of caliper losses, in FIG. 3A in accordance with prior art and in FIG. 3B in accordance with the invention. In FIGS. 3A-3B for purpose of illustration a parent roll of 1.5 m diameter is shown. More typically the parent roll will be about 5 m in diameter. On the X-axis is shown the diameter of a parent roll in mm and on the Y-axis is shown caliper in μm. In FIGS. 3A and 3B graphs 61A, 61B indicate the caliper of the fiber web before the reeling stage in the reel-up. The graphs 62A, 62B show the caliper of the fiber web in the parent roll, and graphs 63A, 63B show the caliper of the fiber web in the customer rolls in the winding stage in the winding section of the slitter-winder. The graphs 64A shown in FIGS. 3A and 3B indicate that in the prior art, a nominal formed web of 500 μm may meet only the requirement of a specified caliper of 455 μm. The graphs 64B according to the invention shown in FIG. 3B indicate the caliper which a nominal formed web of 500 μm can meet is a specified caliper of 475 μm. The reference numerals followed by the letter A indicate the values achieved by the prior art and the reference numerals followed by the letter B indicate the values achieved by the invention. As can be seen from FIG. 3A, in prior art systems the difference between the minimum caliper which a nominal formed web 61A of 500 μm can meet (the target value 64A for the caliper), is large; but as can be seen from the FIG. 3B in the invention the difference between the target value 64B of the caliper and the nominal formed web 61B of 500 μm caliper is much smaller scale, and the difference between the required target values, graphs 64A, 64B of the prior art and the invention is great and thus, the situation has significantly improved. Thus the nominal formed web of 500 μm can meet the target value 64B which is 20 μm greater or about 4.44% greater than the target value of prior art 64A.

Figure 4A:
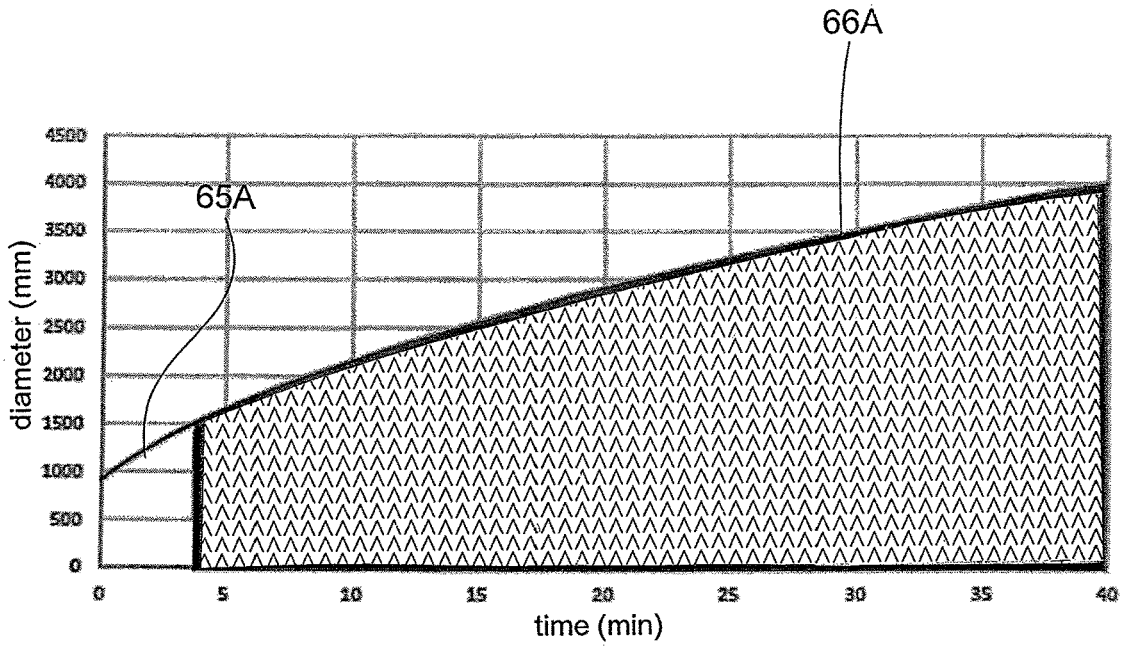
Fig. 4A prior art
In FIGS. 4A-4B is schematically shown portion of one caliper run of a parent roll, in FIG. 4A in accordance prior art and in FIG. 4B in accordance with the invention.
Figure 4B:
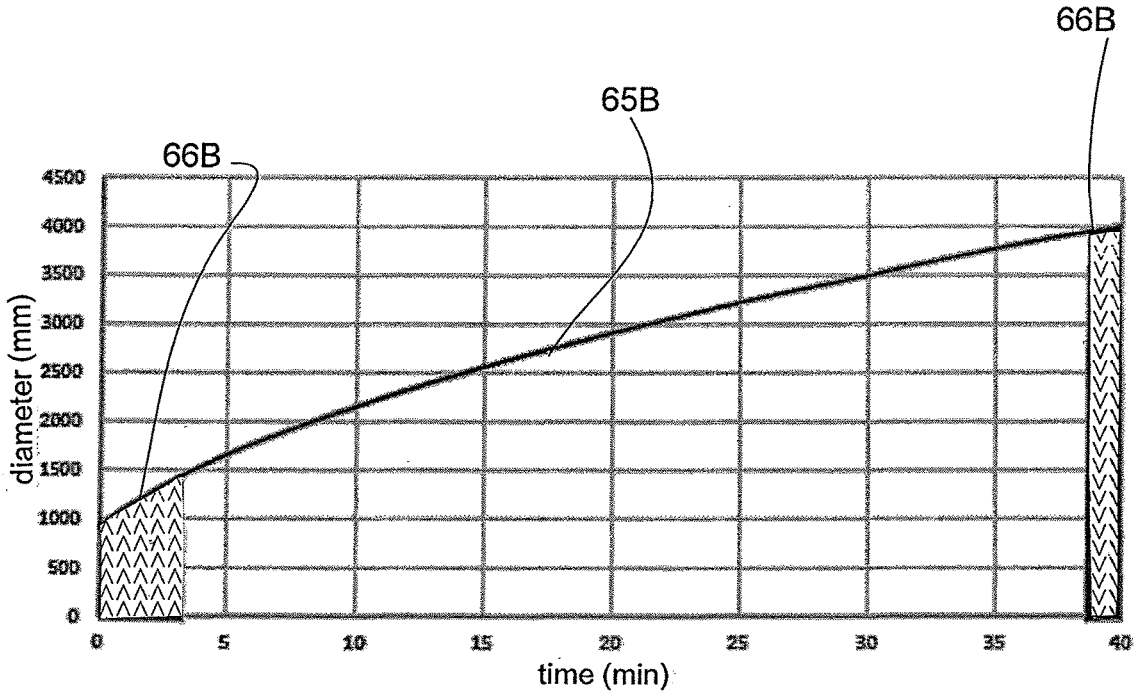

In FIGS. 4A-4B is schematically shown a portion of over caliper run of a parent roll, in FIG. 4A in accordance with prior art and in FIG. 4B in accordance with the invention. As can be seen from FIG. 4A in the prior art the running time in over caliper is about 90% of the running time of the parent roll unwinding but in the invention as can be seen from FIG. 4B the running time in over caliper is only about 10% of the running time of the parent roll unwinding and thereby, the situation has significantly improved. Graphs 65A, 65B illustrate the diameter of the parent roll as a function of time and the covered areas 66A, 66B illustrate the portion of over caliper run.

In the description in the foregoing, although some functions have been described with reference to certain features and examples, those functions may be performable by other features and examples whether described or not. Although features have been described with reference to the certain examples, those features may also be present in other examples whether described or not.

Above only some advantageous examples of the inventions have been described to which examples the invention is not to be narrowly limited and many modifications and alterations are possible within the invention.

I claim:

1. A method in a fiber web production line of minimizing changes in caliper of a fiber web produced on the fiber web production line after the fiber web is wound into a parent roll, the method comprising the steps of:

forming a fiber web in web production line of a targeted caliper, wherein before a parent roll is started in a reel-up of the fiber web production line, a first length of the fiber web is formed with a caliper greater than the targeted caliper such that as the parent roll is begun, the first length of the fiber web is wound to form a first part of the parent roll with the fiber web of greater caliper;

while the parent roll is being wound, adjusting the web production line to change the caliper of the fiber web, and thereby winding a second part of the parent roll with the fiber web having a second length with a caliper of the targeted caliper to form the parent roll, wherein the second length is greater than the first length; and wherein the fiber web of greater caliper is arranged on the interior of the wound parent roll so as to compensate for reduction of web caliper in the parent roll as wound.

2. The method of claim 1 wherein the first length of the fiber web is 5-10% of the fiber web wound to form the parent roll which comprises the first length of the fiber web of greater caliper plus the second length of the fiber web of the targeted caliper.

3. The method of claim 1 further comprising the steps of:

measuring the caliper of the fiber web as and/or after the fiber web is unwound in an unwinding station of the fiber web production line to determine an unwound caliper measurement;

comparing the unwound caliper measurement to the targeted caliper, and on finding if the unwound caliper measurement to be is less than the targeted caliper, increasing the formed caliper of a subsequent first length of the fiber web formed with a caliper greater than the targeted caliper which is wound in the fiber web production line on a subsequent parent roll; and on finding the unwound caliper measurement is to be greater than the targeted caliper, decreasing the formed caliper of a subsequent first length of the fiber web formed with a caliper greater than the targeted caliper which is wound in the fiber web production line on a subsequent parent roll.

4. The method of claim 3 wherein the step of measuring the caliper of the fiber web as and/or after the fiber web is unwound in an unwinding station is preformed by taking samples of the fiber web after unwinding in the unwinding station and measuring the caliper of the samples.

5. The method of claim 3 wherein the step of measuring the caliper of the fiber web as and/or after the fiber web is unwound in an unwinding station is preformed by measuring the diameter of the parent roll as it unwinds and calculating the fiber web caliper.

6. The method of claim 3 further comprising the step of measuring the caliper of the fiber web which was unwound in the unwinding station as said fiber web is wound into a customer roll in a winding station of the fiber web production line.

7. The method of claim 6 wherein the step of measuring the caliper of the fiber web as the fiber web is wound into a customer roll, is by taking samples of the fiber web as the fiber web is wound into the customer roll and measuring the caliper of the samples.

8. The method of claim 6 wherein the step of measuring the caliper of the fiber web as the fiber web is wound into a customer roll, is by measuring the diameter of the customer roll as it is wound and calculating the fiber web caliper.

9. The method of claim 8 wherein the fiber web production line further comprises a parent roll storage with a parent roll sample taking station and/or a customer roll storage with a customer roll sample taking station and wherein caliper data from either the customer roll sample taking station or the parent roll sample taking station is used to determine a time-interval of producing a first length of fiber web with a caliper greater than the targeted caliper for winding of a subsequent parent web.

10. The method of claim 1 where the step of forming the first length of the paper web with the caliper greater than the targeted caliper in the fiber web production line is selected from the group consisting of:

decreasing the production speed of the web in a forming section, increasing headbox flow in a head box, increasing head-box consistency, increasing coating weight of a coating paste in a coater section, and reducing calender nip load in a calender.

11. The method of claim 1 wherein the first length of the fiber web wound on the parent roll is provided to have a fiber web caliper which is a function of the diameter of the parent roll.

12. The method of claim 1 wherein the caliper of the first length of the fiber web is provided with caliper values exceeding the target value by decreasing the running speed of the production line.

13. The method of claim 1 wherein the caliper of the first length of the fiber web is provided with caliper values exceeding the target value by increasing headbox-flow of a headbox within the fiber web production line.

14. The method of claim 1 wherein the caliper of the first length of the fiber web is provided with caliper values exceeding the target value by increasing head-box consistency within a headbox within the fiber production line.

15. The method of claim 1 wherein an unwinding station unwinds the parent roll subsequent to its being wound on the fiber web production line, and wherein an on-line sensor with a calculation system is disposed with respect to said unwinding station which transmits caliper data on the basis of which is determined a time-interval of producing a first length of fiber web with a caliper greater than the targeted caliper for winding of a subsequent parent web.

16. The method of claim 1 wherein the parent roll is unwound at an unwinding station subsequent to its being wound on the fiber web production line, and is then wound on customer rolls at a winding section, wherein an on-line sensor with a calculation system is disposed with respect to said winding section which transmits caliper data on the basis of which is determined a time-interval of producing a first length of fiber web with a caliper greater than the targeted caliper for winding of a subsequent parent web.

17. The method of claim 1 wherein the method further comprises the steps of:

setting the target caliper of the fiber web;

selecting running parameters to produce a fiber web with the target caliper;

measuring the web caliper in the parent roll as and/or after the fiber web is unwound in an unwinding station;

based on the received caliper data determining whether the caliper of the fiber web as a function of the diameter of the parent roll is constant in the parent roll or in a customer roll; and on determining the caliper of the fiber web in the parent roll or in the customer roll is not constant, changing a diameter dependent correction factor and repeating the foregoing steps starting with the selecting running parameters, and changing at least one running parameter.

18. A method in a fiber web production line of minimizing changes in caliper of a fiber web produced on the fiber web production line after the fiber web is wound into a parent roll, the method comprising the steps of:

forming a fiber web in the fiber web production line and reeling the fiber web on to a first parent roll in a reel-up of the fiber web production line, such that a first length of the fiber web is formed with a caliper greater than a target caliper such that as the parent roll is begun, the first length of the fiber web is wound to form an inner part of the parent roll;

while the parent roll is being wound, adjusting the web production line to decrease the caliper of the fiber web to the target caliper, and winding a second part of the parent roll with the fiber web having a second length with the target caliper to form the parent roll, wherein the second length is greater than the first length and is disposed exterior to the inner part of the parent roll.

19. The method of claim 18 further comprising the step of adjusting the fiber web production line while the first parent roll is being wound to increase the caliper of the fiber web just before a reel change, and winding a second subsequent parent roll in the reel-up, so the second parent roll starts with a fiber web having a caliper higher than the target caliper.

* * * * *